US009897278B2

(12) United States Patent
Lin et al.

(10) Patent No.: US 9,897,278 B2
(45) Date of Patent: Feb. 20, 2018

(54) REFLECTOR AND LIGHT EMITTING DIODE ILLUMINATION DEVICE HAVING THE SAME

(71) Applicant: ADVANCED OPTOELECTRONIC TECHNOLOGY, INC., Hsinchu Hsien (TW)

(72) Inventors: Hao-Xiang Lin, Hsinchu (TW); Chung-Min Chang, Hsinchu (TW)

(73) Assignee: ADVANCED OPTOELECTRONIC TECHNOLOGY, INC., Hsinchu Hsien (TW)

( * ) Notice: Subject to any disclaimer, the term of this patent is extended or adjusted under 35 U.S.C. 154(b) by 228 days.

(21) Appl. No.: 14/808,566

(22) Filed: Jul. 24, 2015

(65) Prior Publication Data

US 2016/0061412 A1 Mar. 3, 2016

(30) Foreign Application Priority Data

Aug. 6, 2015 (CN) ..... 2014 1 0442548

(51) Int. Cl.

| | |
|---|---|
| ***F21V 7/04*** | (2006.01) |
| ***F21V 7/00*** | (2006.01) |
| ***F21V 7/05*** | (2006.01) |
| *F21Y 103/10* | (2016.01) |
| *F21Y 115/10* | (2016.01) |
| *F21Y 113/13* | (2016.01) |

(52) U.S. Cl.

CPC ..... *F21V 7/0008* (2013.01); *F21V 7/0025* (2013.01); *F21V 7/0033* (2013.01); *F21V 7/05* (2013.01); *F21V 7/0066* (2013.01); *F21Y 2103/10* (2016.08); *F21Y 2113/13* (2016.08); *F21Y 2115/10* (2016.08)

(58) Field of Classification Search

CPC .... F21V 7/0008; F21V 7/0025; F21V 7/0033; F21V 7/0041; F21V 7/05

See application file for complete search history.

(56) References Cited

U.S. PATENT DOCUMENTS

| | | | | |
|---|---|---|---|---|
| 4,434,453 A * | 2/1984 | Campbell | F21S 8/00 362/145 |
| 5,359,503 A | 10/1994 | Myodo et al. | |
| 2011/0058353 A1* | 3/2011 | Yang | A47F 3/001 362/84 |
| 2014/0092594 A1* | 4/2014 | Radl | F21V 7/0008 362/235 |

* cited by examiner

*Primary Examiner* — Andrew Coughlin
*Assistant Examiner* — Nathaniel Lee
(74) *Attorney, Agent, or Firm* — ScienBiziP, P.C.

(57) ABSTRACT

A reflector configured for reflecting light emitted from a light emitting diode (LED) toward a desired area is provided. The reflector defines a groove therein for accommodating the LED. Light emitted from the LED is reflected by an inner surface of the reflector toward a desired area located below the reflector, wherein the light reflected out of the reflector travels along a direction opposite to the main emitting direction of the LED. An LED illumination device incorporating the reflector is also provided.

12 Claims, 3 Drawing Sheets

REFLECTOR AND LIGHT EMITTING DIODE ILLUMINATION DEVICE HAVING THE SAME

CROSS-REFERENCE TO RELATED APPLICATIONS

This application claims priority to Chinese Patent Application No. 201410442548.1 filed on Sep. 2, 2014, the contents of which are incorporated by reference herein.

FIELD

The subject matter herein generally relates to a reflector, especially also relates to a light emitting diode illumination device having the reflector.

BACKGROUND

Light emitting diodes (LEDs) have been used widely in the illumination field because of the high efficiency, energy saving, and long life cycle thereof. Light emitted from the LED is projected around an axis of the LED. LED devices often are implemented in arrays of multiple LEDs in a single fixture.

BRIEF DESCRIPTION OF THE DRAWINGS

Implementations of the present technology will now be described, by way of example only, with reference to the attached figures.

DETAILED DESCRIPTION OF EMBODIMENTS

It will be appreciated that for simplicity and clarity of illustration, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure. The description is not to be considered as limiting the scope of the embodiments described herein.

Several definitions that apply throughout this disclosure will now be presented. The term "comprising" means "including, but not necessarily limited to"; it specifically indicates open-ended inclusion or membership in a so-described combination, group, series and the like.

Figure 1:
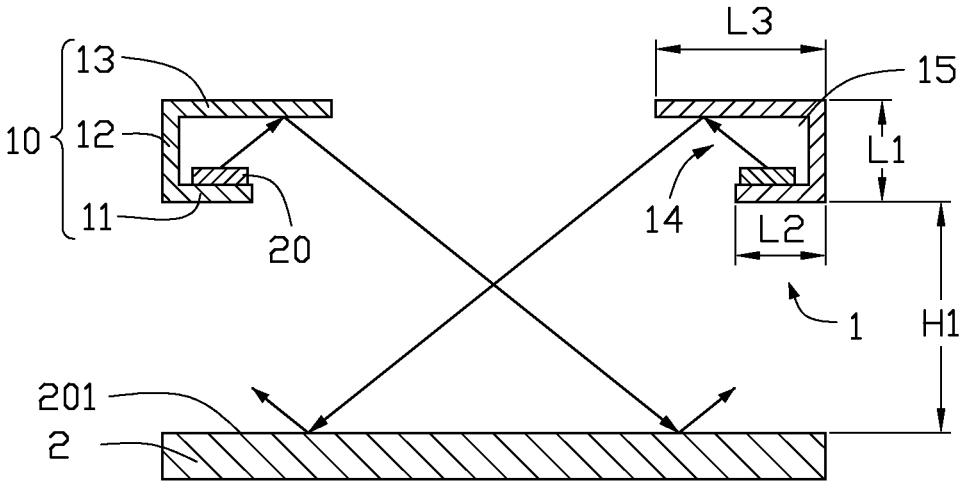
FIG. 1 is a cross sectional view of an LED illumination device with a table of a first embodiment of the present disclosure.

Referring to FIG. 1, a light emitting diode (LED) illumination device 1 includes a plurality of LEDs 20 and two reflectors 10 incorporating with the LEDs 20. The LED illumination device 1 emits light to a table 2 located below the LED illumination device 1. While a table 2 is provided herein, the present disclosure contemplates replacing the table 2 with any surface that is substantially flat and satisfies the other conditions of the table present herein. The two reflectors 10 are located at opposite side of a top of the table 2 and configured symmetrically about an imaginary surface perpendicularly to the table 2.

Each reflector 10 defines a groove 15 therein. The LEDs 20 are received in the groove 15. Light emitted from the LED 20 is reflected by an inner surface of the reflector 10 and to be projected towards the table 2. A projecting direction of the light is contrary with a direction of the light emitted from the LEDs 20.

A cross section of the reflector 10 is L-shaped. Each reflector 10 includes a first reflecting plate 11, a second reflecting plate 12 and a third reflecting plate 13. The third reflecting plate 13 is configured above and relatively to the first reflecting plate 11. The second reflecting plate 12 connects the first reflecting plate 11 and the third reflecting plate 13. Specifically, the first reflecting plate 11, the second reflecting plate 12 and the third reflecting plate 13 cooperatively defines the groove 15. A side of the reflector 10 has an opening 14 relative to the second reflecting plate 12 such that the groove 15 directly contacts with external by the opening 14.

In at least one embodiment, a top surface of the first reflecting plate 11 and the third reflecting plate 13 are configured parallelly to a top surface 201 of the table 2, and both sides surface of the second reflecting plate 12 configured vertically with the top surface 201 of the table 2. A length of the third reflecting plate 13 is more than that of the first reflector plate 11. Left ends of first reflecting plate 11 and the third reflecting plate 13 are coplanar. The second reflecting plate 12 connects the left ends of the first reflecting plate 11 and the third reflecting plate 13. A right end of the third reflecting plate 13 is beyond a right end of the first reflecting plate 11. The reflector 10 is made of thermal conductive material, such as aluminum, or cooper.

The LEDs 20 are mounted on the top surface the first reflecting plate 11 and spaced from the third reflecting plate 13. Light emitted From the LEDs 20 is reflected by the first reflecting plate 11 and the third reflecting plate 13 to exit through the opening 14. In this embodiment, the LEDs 20 includes a plurality of white LEDs arranged in series near the opening 14. In other embodiment, the LEDs 20 includes a red LED, a green LED and a blue LED to mix to be white light in the groove 15.

Figure 2:
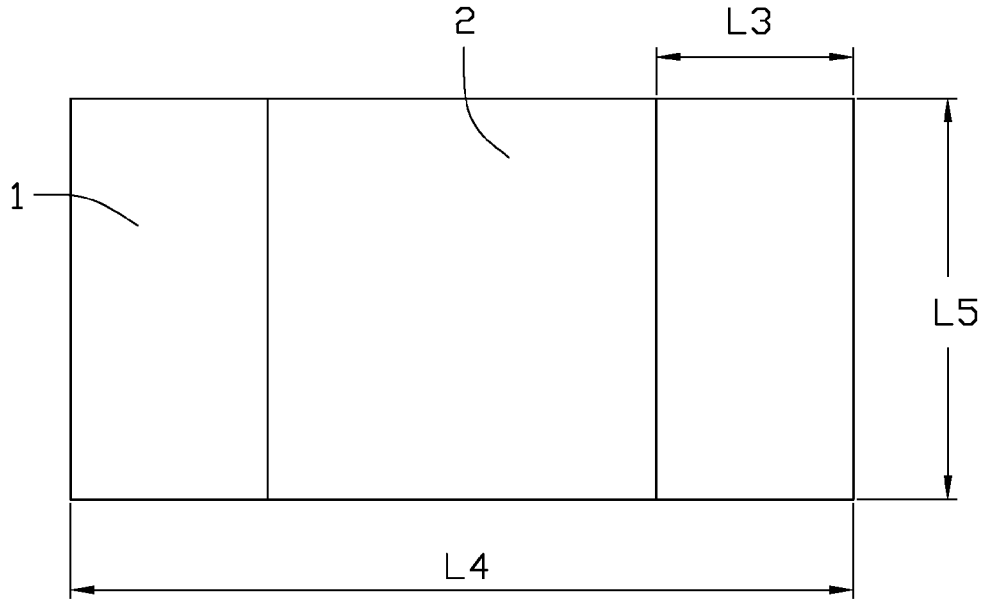
FIG. 2 is a diagrammatic view of the LED illumination device projecting on the table of FIG. 1.

Also referring to FIG. 2, the table 2 has a length of L4, and a width of L5. A width of the reflector 10 is equal to that of the table 2. An area of the reflector 10 projected to the top surface 201 of the table 2 has a width of L3. In one example, the length L4 is 120 cm, and the width L5 is 60 cm. The two reflectors 10 are located at two ends along the long direction thereof and above the table 2. A distance between the reflector 10 and the table 2 is a height H1. The height H1 can be 50 cm.

Because the reflector 10 has the width equal to the table 2, the length of the reflector 10 is not changed. Only changes the length of the third reflecting plate 13 can change the area of the LED illumination device 1 projected to the table 2 to adjust the light intensity provided by the LED illumination device 1 on the table 2. Generally, the light intensity uniformity is a ratio between the lowest light intensity and the average light intensity, and has nothing with a shape of the LEDs 20 and the reflector 10. So the light intensity uniformity of the LED illumination device 1 projected to the table 2 can be adjusted by changing the length of the third reflecting plate 13.

In one embodiment, a ratio between an area of the third reflecting plate 13 projected to the table 2 and the top surface 201 of the table is defined X. The X and the light intensity uniformity have relations as following chart:

| X | Light intensity uniformity |
|---|---|
| 0.2 | 0.648 |
| 0.15 | 0.67 |
| 0.1 | 0.667 |
| 0.05 | 0.63 |
| 0.0167 | 0.679 |
| 0.0142 | 0.63 |
| 0.0136 | 0.604 |
| 0.0133 | 0.587 |
| 0.0116 | 0.466 |

As illustrated in the chart, while the X>0.0136, the light intensity uniformity is less than 0.6. However, in order to have a great light effect, the light intensity uniformity is greater than 0.6. Therefore, a relationship can be construed as 0.0136≤x≤1.

Figure 3:
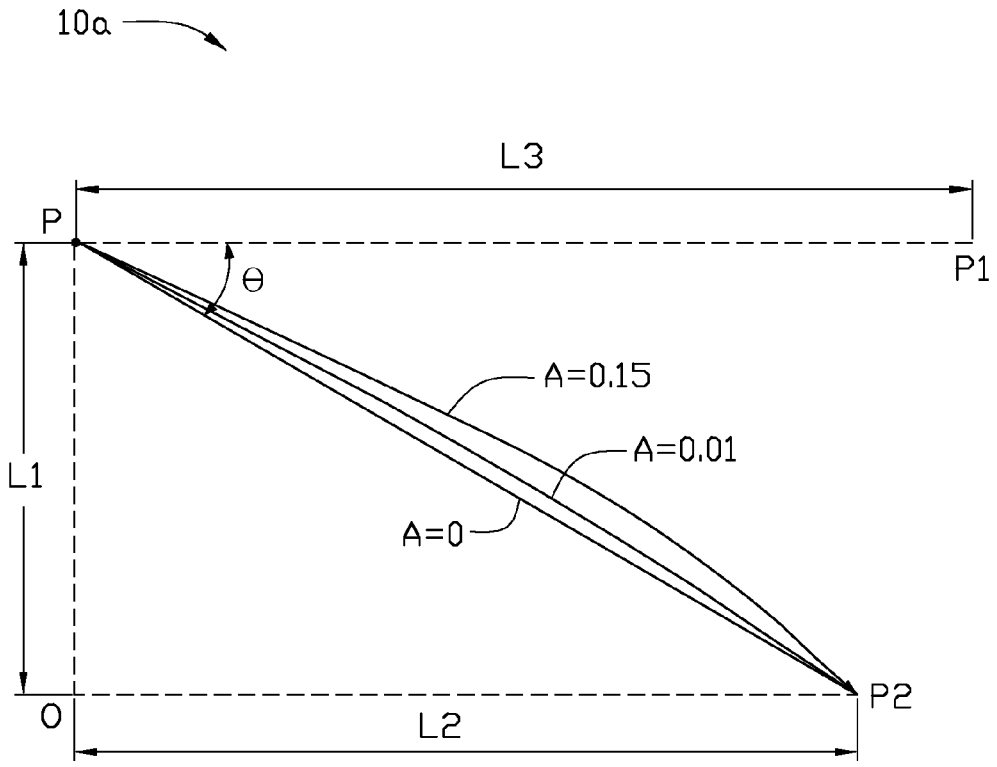
FIG. 3 is a cross sectional view of the reflector of FIG. 1 showed from a second embodiment of the present disclosure.

Further referring to FIG. 3, a reflector 10*a* of the LED illumination device 1 of a second embodiment is provided. The reflector 10*a* differing from the reflector 10 is that the third reflecting plate 13 has arc-shaped. A cross sectional of the third reflecting plate 13 is arc.

A length of the first reflecting plate 11 projected to the table 2 is L1. The length of the second reflecting plate 12 is L2. A length of the third reflecting plate 13 projected to the table 2 is L3. The second reflecting plate 12 interconnects between the first reflecting plate 11 and the third reflecting plate 13. The first reflecting plate 11 and the second reflecting plate 12 form a connecting point labeled as "O". The second reflecting plate 12 and the third reflecting plate 13 form a connecting point labeled as "P". The third reflecting plate 13 has an end point labeled as "$P_3$" that faces away from the connecting point "P". The first reflecting plate 11 has an end point labeled as "$P_2$" that faces away from the connecting point "O". A projection of the first reflecting plate 11 along a direction paralleled with the top surface 201 of the table 2 defines a vector $\overrightarrow{OP_2}$. The second reflecting plate 12 along an extending direction thereof defines a vector $\overrightarrow{OP}$. The projection of the third reflecting plate 13 along a direction paralleled with the top surface 201 of the table 2 defines a vector $\overrightarrow{PP_1}$. "$P_1$" is defined as an end point of the vector $\overrightarrow{PP_1}$ facing away from the connecting point "P". The third reflecting plate 13 along an extending direction thereof defines a vector $\overrightarrow{PP_3}$. A vector $\overrightarrow{PP_2}$ is defined from the connecting point "P" to the end point "$P_2$". The $\overrightarrow{PP_3}$ satisfies following relations:

$$\overrightarrow{PP_3} = \left[\frac{2AV(1-V)}{1+2(A-1)V+2(1-A)V^2}\right]\overrightarrow{PP_1} + \left[\frac{V^2}{1+2(A-1)V+2(1-A)V^2}\right]\overrightarrow{PP_2}$$

The A and the V are constant, and 0≤A≤1000, 0≤V≤1. While the A is constant, the V is changed from 0 to 1 to form the trajectory of the third reflecting plate 13. An angle is defined between the $\overrightarrow{PP_1}$ and the $\overrightarrow{PP_2}$. The $\overrightarrow{PP_3}$ is located in the angle. While the length of L1 is equal to the length of L2, the angle is 45°.

While the A is increased, the $\overrightarrow{PP_3}$ gradually moves towards the $\overrightarrow{PP_1}$; while the A is reduced, the $\overrightarrow{PP_3}$ gradually moves towards the $\overrightarrow{PP_2}$. For example, while the A=0, the $\overrightarrow{PP_3}$ overlaps together with the $\overrightarrow{PP_1}$.

While the X=0.1, the relation between A and the light intensity uniformity illustrated as following chart:

| A | Light intensity uniformity |
|---|---|
| 0.15 | 0.679 |
| 0.13 | 0.683 |
| 0.12 | 0.717 |
| 0.1 | 0.73 |
| 0.05 | 0.738 |
| 0.01 | 0.72 |
| 0 | 0.73 |

As illustrated in the chart, while X=0.1, the scope of A is: 0≤A≤0.15, and the light intensity uniformity is more than 0.667.

In the present disclosure, the light emitted from the LEDs 20 is reflected by the reflector 10 or reflector 10*a* to be projected to the table 2. So adjusting the light intensity uniformity at the table 2 is by changing the area of the reflector 10 and the reflector 10*a* projected to the table 2, or by changing the shaped of the reflector 10 or the reflector 10*a*. So the light reflected by the reflector 10 or the reflector 10*a* to be projected to the table 2 has uniform light intensity.

The embodiments shown and described above are only examples. Many details are often found in the art such as the other features of a reflector and LED illumination device having the same. Therefore, many such details are neither shown nor described. Even though numerous characteristics and advantages of the present technology have been set forth in the foregoing description, together with details of the structure and function of the present disclosure, the disclosure is illustrative only, and changes can be made in the detail, including in matters of shape, size and arrangement of the parts within the principles of the present disclosure up to, and including the full extent established by the broad general meaning of the terms used in the claims. It will therefore be appreciated that the embodiments described above can be modified within the scope of the claims.

What is claimed is:

1. A reflector for reflecting the light from light emitting diode (LED) to a table, the table comprising a top surface, the reflector comprising:

a first reflecting plate located opposite to the top surface of the table;

a second reflecting plate; and a third reflecting plate configured above and relatively to the first reflecting plate;

wherein the second reflecting plate interconnects between the first reflecting plate and the third reflecting plate, the first reflecting plate and the second reflecting plate form a connecting point labeled as "O", the second reflecting plate and the third reflecting plate form a connecting point labeled as "P", the third reflecting plate has an end point labeled as "$P_3$" that faces away from the connecting point "P", the first reflecting plate has an end point labeled as "$P_2$" that faces away from the connecting point "O", the first reflecting plate, the second reflecting plate, and the third reflecting plate cooperatively defines a groove for receiving the LED;

light emitted from the LED is reflected by an inner surface of the third reflecting plate to be projected to the top surface of the table, a direction of the light emitted from the LED is contrary with a direction of light projecting towards the table; and wherein a projection of the first reflecting plate along a direction parallel to the top surface of the table defines a vector $\overrightarrow{OP_2}$, the second reflecting plate 12 along an extending direction thereof defines a vector $\overrightarrow{OP}$, a projection of the third reflecting plate along a direction parallel to the top surface of the table defines a vector $\overrightarrow{PP_1}$, "$P_1$" is defined as an end point of the vector $\overrightarrow{PP_1}$ facing away from the connecting point "P", the third reflecting plate along an extending direction thereof defines a vector $\overrightarrow{PP_3}$, a vector $\overrightarrow{PP_2}$ is defined from the connecting point "P" to the end point "$P_2$", the $\overrightarrow{PP_3}$ satisfies the following relation:

$$\overrightarrow{PP_3} = \left[\frac{2AV(1-V)}{1+2(A-1)V+2(1-A)V^2}\right]\overrightarrow{PP_1} + \left[\frac{V^2}{1+2(A-1)V+2(1-A)V^2}\right]\overrightarrow{PP_2}$$

wherein the A and V are constants, and $0 \le A \le 1000$, $0 \le V \le 1$.

2. The reflector of claim 1, wherein a cross section of the reflector is L-shaped.

3. The reflector of claim 1, wherein the second reflecting plate connects the first reflecting plate and the third reflecting plate.

4. The reflector of claim 1, wherein a length of the third reflecting plate is more than that of the first reflecting plate.

5. The reflector of claim 1, wherein a width of the third reflecting plate is equal to that of the table.

6. The reflector of claim 1, wherein a ratio of an area of the third reflecting plate projected to the table and the top surface of the table is defined x, and $0.0136 \le x \le 1$.

7. The reflector of claim 1, wherein left ends of the first reflecting plate and the third reflecting plate are coplanar.

8. The reflector of claim 1, wherein right end of the third reflecting plate is beyond a right end of the first reflecting palte.

9. The reflector of claim 1, wherein a side of the reflector have an opening relative to the second reflecting plate.

10. The reflector of claim 1, wherein while X=0.1, the scope of A is: $0 \le A \le 0.15$.

11. The reflector of claim 1, wherein the reflector is made of thermal conductive material.

12. A light emitting diode device, comprising:

a light emitting diode (LED);

a reflector for reflecting the light from the LED to a table, the table comprising a top surface, the reflector comprising:

a first reflecting plate located opposite to the top surface of the table;

a second reflecting plate; and a third reflecting plate configured above and relatively to the first reflecting plate;

wherein the second reflecting plate interconnects between the first reflecting plate and the third reflecting plate, the first reflecting plate and the second reflecting plate form a connecting point labeled as "O", the second reflecting plate and the third reflecting plate form a connecting point labeled as "P", the third reflecting plate has an end point labeled as "$P_3$" that faces away from the connecting point "P", the first reflecting plate has an end point labeled as "$P_2$" that faces away from the connecting point "O", the first reflecting plate, the second reflecting plate and the third reflecting plate cooperatively defines a groove for receiving the LED;

light emitted from the LED is reflected by an inner surface of the reflector to be projected to the top surface of the table, a direction of the light emitted from the LED is contrary with a direction of light projected towards the table;

wherein a projection of the first reflecting plate along a direction parallel to the top surface of the table defines a vector of $\overrightarrow{OP_2}$, the second reflecting plate 12 along an extending direction thereof defines a vector $\overrightarrow{OP}$, a projection of the third reflecting plate along a direction parallel to the top surface of the table defines a vector $\overrightarrow{PP_1}$, "$P_1$" is defined as an end point of the vector $\overrightarrow{PP_1}$ facing away from the connecting point "P", the third reflecting plate along an extending direction thereof defines a vector $\overrightarrow{PP_3}$, a vector $\overrightarrow{PP_2}$ is defined from the connecting point "P" to the end point "$P_2$", the $\overrightarrow{PP_3}$ satisfies the following relation:

$$\overrightarrow{PP_3} = \left[\frac{2AV(1-V)}{1+2(A-1)V+2(1-A)V^2}\right]\overrightarrow{PP_1} + \left[\frac{V^2}{1+2(A-1)V+2(1-A)V^2}\right]\overrightarrow{PP_2}$$

wherein the A and V are constants, and $0 \le A \le 1000$, $0 \le V \le 1$.

* * * * *